US005184435A

United States Patent [19]

Sherman

[11] Patent Number: 5,184,435

[45] Date of Patent: Feb. 9, 1993

[54] READILY CLEANABLE GUTTER AND GUTTER CONVERSION METHOD

[75] Inventor: Bernard Sherman, Paramus, N.J.

[73] Assignee: Ventive, Inc., Paramus, N.J.

[21] Appl. No.: 617,811

[22] Filed: Nov. 26, 1990

[51] Int. Cl.[5] ..... E04D 13/06

[52] U.S. Cl. ..... 52/12; 52/11; 248/48.2

[58] Field of Search ..... 52/11, 12; 248/48.2

[56] References Cited

U.S. PATENT DOCUMENTS

| | | | |
|---|---|---|---|
| 4,072,285 | 2/1978 | Greenwood | 52/11 |
| 4,199,121 | 4/1980 | LeFebvre | 52/12 |
| 4,309,792 | 1/1982 | Faye | 52/11 |
| 4,311,292 | 1/1982 | Deason | 52/11 |
| 4,669,232 | 6/1987 | Wyatt | 52/12 |
| 4,813,190 | 3/1989 | Wittig | 52/11 |
| 4,837,987 | 6/1989 | Fender | 52/11 |

*Primary Examiner*—David A. Scherbel
*Assistant Examiner*—Joanne C. Downs
*Attorney, Agent, or Firm*—Morris I. Pollack

[57] ABSTRACT

A system is provided for converting conventionally hanger-hung gutters fixedly disposed to receive water from building roofs to a gutter system wherein the gutters are selectively movable between water receiving dispositions and overturned dispositions to facilitate dumping debris from the gutters. The system entails securing first portions of gutter mounting brackets in spaced relationship along the length of the gutter proximate the lower edge of the gutter front wall and securing a second portion of the gutter mounting brackets to the building facia while the gutters are still secured to the building by the conventional gutter hangers. A pivot pin connects the mounting bracket first and second portions to permit the selective gutter movements. Selective movement of the gutters is effected by use of a rod operated by a person standing on the ground beneath the gutters and the application of force in selected manner to the gutter. The same gutter mounting brackets can also be utilized to mount gutters to buildings in original installations rather than conversions. The mounting brackets may utilize either a single or a pair of spaced hinge brackets. A flared upper end of a downspout is disposed in proximity to a lead pipe which directs water from the gutters to the downspouts. Rubber gaskets are provided on open ended gutters.

29 Claims, 4 Drawing Sheets

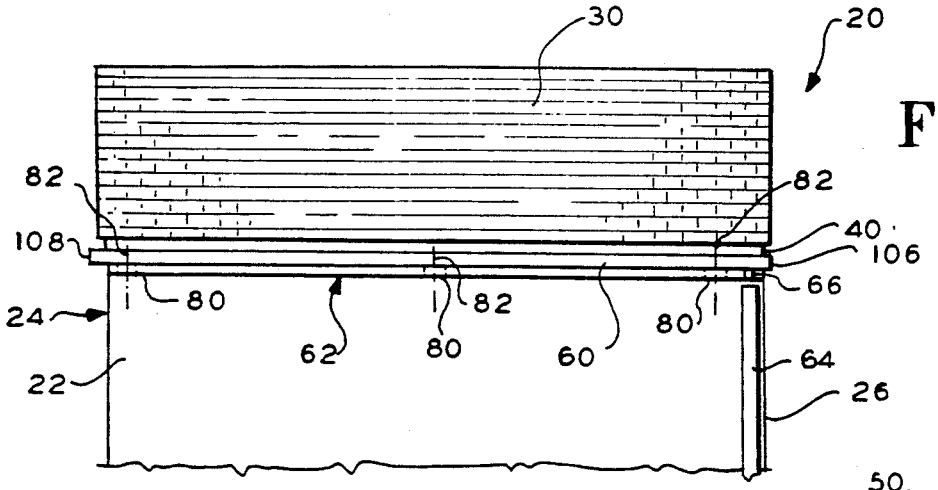
FIG. 1
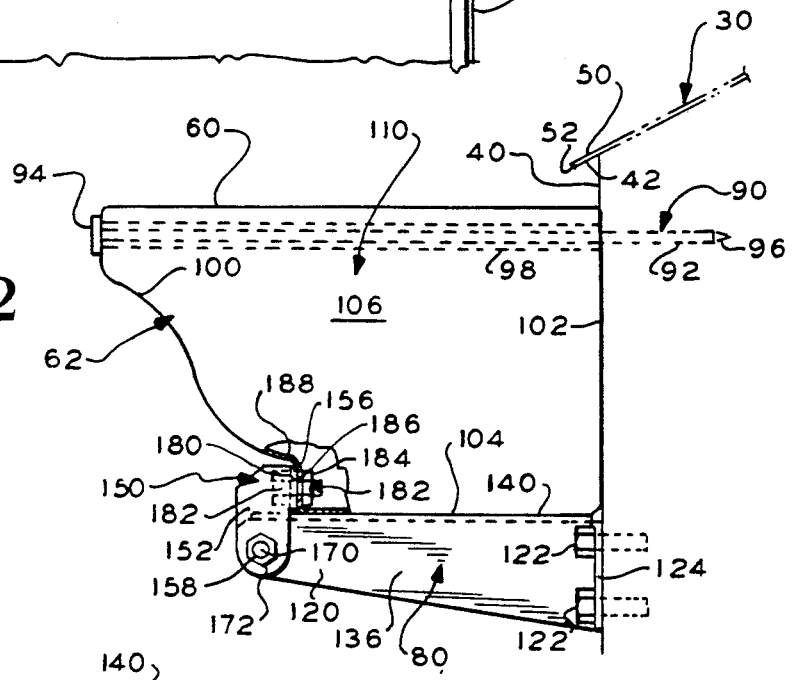
FIG. 2
FIG. 4
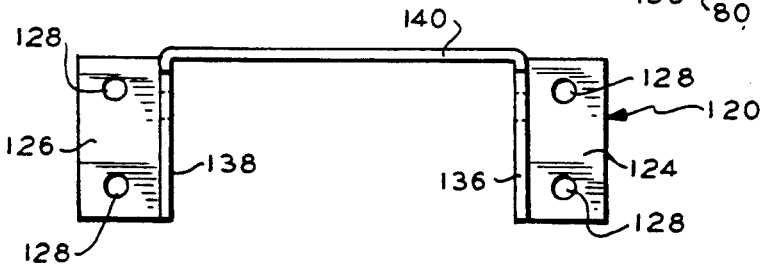
FIG. 5A
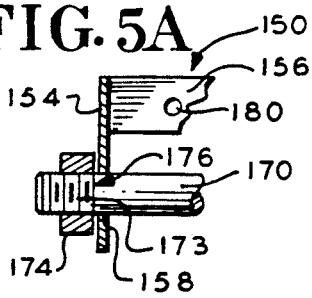
FIG. 5
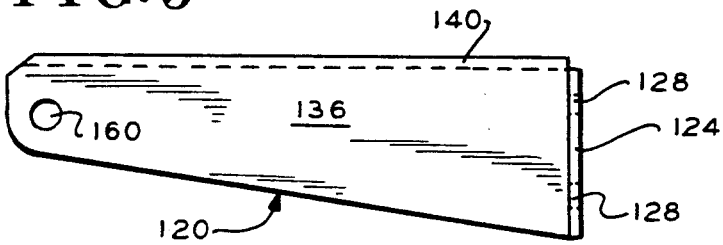

FIG. 3
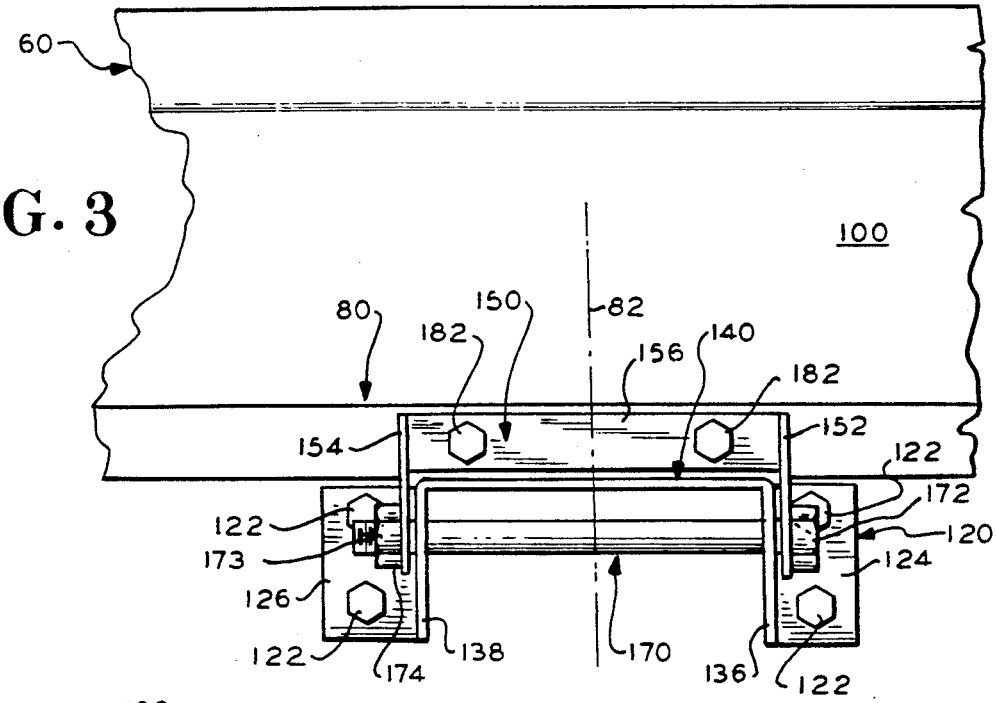
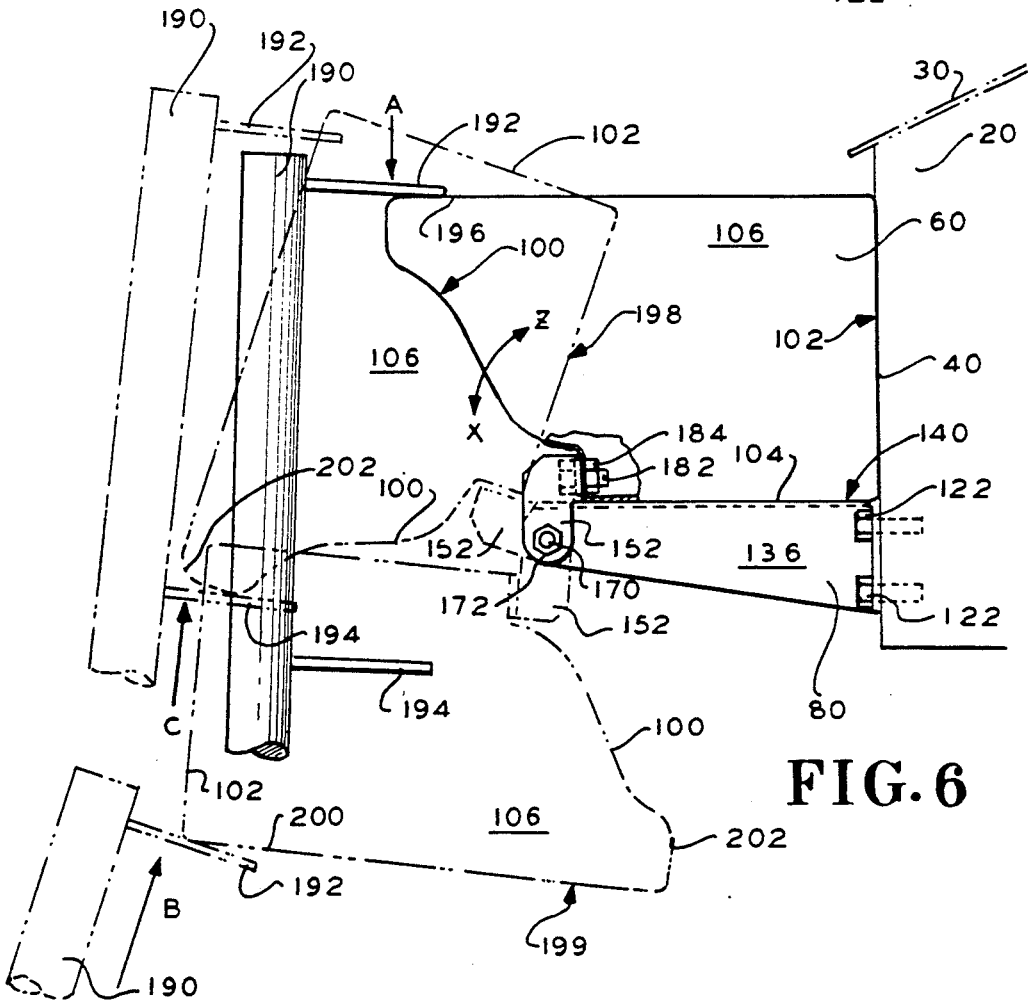
FIG. 6

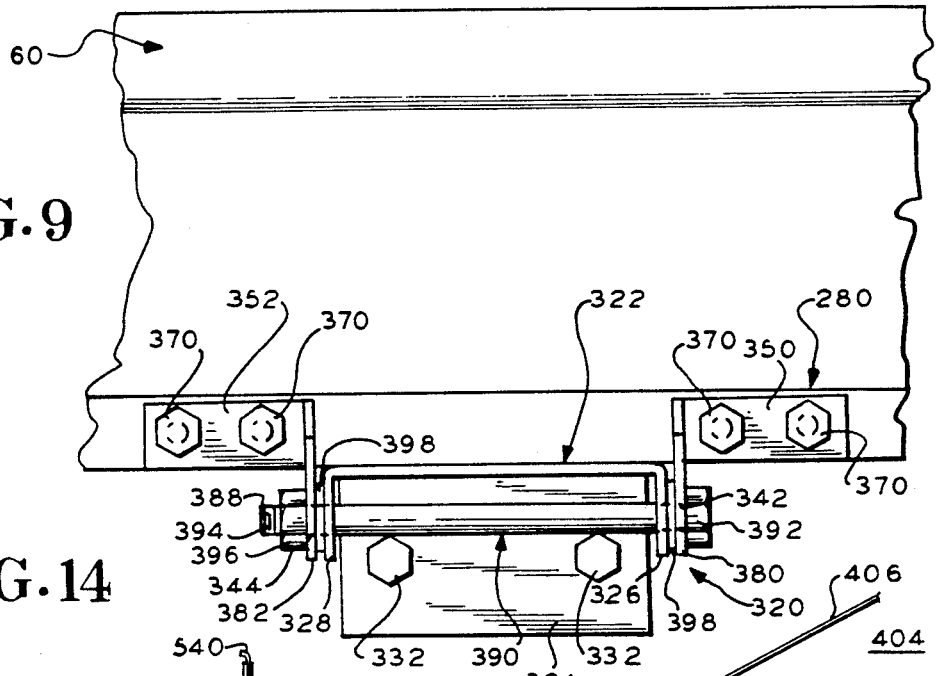
FIG. 9
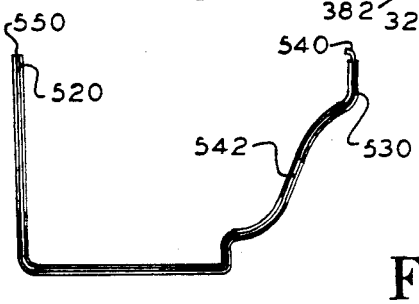
FIG. 14
FIG. 12
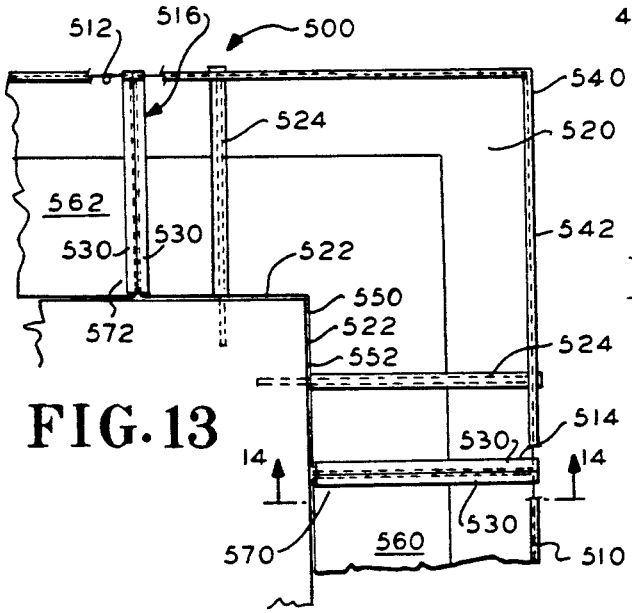
FIG. 13
FIG. 15
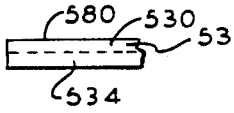
FIG. 16
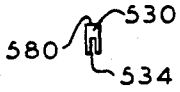

READILY CLEANABLE GUTTER AND GUTTER CONVERSION METHOD

BACKGROUND OF THE INVENTION

1. Field of Application

This invention relates to gutters or drain troughs for buildings; and more particularly, to mountings for such gutters and drain troughs that facilitate cleaning of debris therefrom.

2. Description of the Prior Art

In general, the great majority of buildings (residential, commercial, public, farm, business and the like) have roofs which are slanted, tilted, peaked or otherwise constructed to direct water, snow, ice and the like down off of the roof and towards the ground. Even so-called flat roofed buildings have their roofs constructed with one or more slants to direct water off of the roof. The water from the rain, or the melting snow and ice, is, however, usually not permitted to merely run off of the roof to drop to the ground but is, instead, collected in troughs or gutters which either fully surround or partially surround the roofed structure. The troughs and gutters, in turn, channel the water to downspouts which direct the water down to the ground or to sewers, dry wells or other similar runoffs.

However, the troughs or gutters not only collect and channel water. They also collect leaves, tree branches, and any other debris that should happen to fall upon the structure or building roof. Such debris finds its way into the gutter by being wind blown across the roof into the gutter and/or by being swept along with the flowing water as it travels into the trough or gutter. The water, channelled by the gutter thereafter carries the leaves, branches and other debris towards the downspout where such debris usually collects because all or some of the debris cannot get washed down the downspout. With the downspout clogged the water in the gutter fills up the gutter and then spills over the gutter edges defeating the purpose of using the gutter in the first place. As the water runs over the edges of the gutter it not only falls on people below but it may also damage the ground below and create troughs or marshy ground therein, or it may damage the building as it runs down the buildings walls.

It thus becomes important to clean out the gutters regularly or, if one forgets to do that, to clean them out when reminded to do so by water running over the gutters edges. Climbing up a ladder to clean out gutters is froth with danger on a dry nice day but is especially hazardous when it is windy and rainy and the gutters are overflowing. Many homes are two and three story structures and require long ladders to reach the height of the gutters. These long ladders, propped up against a building or house, are at best delicately balanced and present dangers which result in broken bones, serious injuries and even death from falls. Clearing clogged gutters and downspouts can thus be a dangerous and possibly deadly chore.

U.S. Pat. No. 4,194,780 issued on Mar. 25, 1980 to C. A. Dilley for *Gutter Cleaner Tool* shows and describes a device which extends the reach of the person cleaning out a gutter and facilitates maneuvering about the cross-struts which are conventionally utilized to secure the gutter to a buildings facia and to provide additional support for the otherwise generally thin gutter walls. However, this device still requires that a person climb a ladder or otherwise assume a precarious position above the level of the gutter when operating the device. The dangers inherent in doing so are more than adequately described above.

There are also devices for use in cleaning gutters which are operated from the ground, such as those shown and described: in U.S. Pat. No. 4,196,927 issued on Apr. 8, 1980 to M. Lomaga for *Gutter Cleaning Device;* and in U.S. Pat. No. 4,310,940 issued on Jan. 19, 1982 to E. L. Moore for *Gutter Cleaner.* However, such devices require that a mechanism disposed at the top of a pole be accurately positioned within the gutter and then operated from the ground. The operator, in utilizing such a device, must be careful not to pull the device and the gutter away from the building and must also keep in mind that at regular intervals along the length of the gutter there are gutter hangers which are to be avoided. Such ground operated gutter cleaning devices are thus not only relatively costly and difficult to operate but may also present dangers that many people afflicted with gutters and their inherent problems may prefer to avoid.

Alternative ground operated devices to facilitate gutter cleaning are shown and described in U.S. Pat. No. 4,807,406 issued on Feb. 28, 1989 to J. Densmore for *Self-Cleaning Gutter* and in U.S. Pat. No. 4,837,987 issued on Jun. 13, 1989 to R. V. Fender for *Rain Water Receiving Apparatus With Dumping Feature.* The Densmore construction, however, requires a specially constructed gutter with an elongated wall that is pivotally mounted and the disposition of rotating devices within the gutter and downspout (and the water running therein) that may not only unduly add to the cost of the installation but may also rust and/or freeze rendering operation thereof quite difficult if not impossible. The Fender construction, on the other hand, requires that the gutters be mounted on brackets that space the inner wall of the gutter away from the structure, and the use of an elongate rod stretching the length of the gutters. Spacing the inner wall of the gutters away from the facia of the building will permit water to run down the building face if the gutter overflows and this may result in stains and water damage to the building. In addition, because this type of gutter mounting spaces the gutter from the building face a greater degree of roof must overhang the gutter to direct the water into the gutter. If the roof is already in place such additional overhang may not be possible if one is to convert a gutter hung by conventional gutter hangers to that described. Moreover, the use of a rod stretching the length of the gutter may prove to be unsightly as to render such a gutter construction undesirable. In addition, because Densmore requires a special gutter construction and Fender requires the disposition of brackets between the gutter and the building neither of these constructions permit the ready conversion of gutters supported by conventional gutter hangers to a ground operated gutter cleaning system utilizing the in-place gutters.

Still other gutter constructions to facilitate gutter cleaning are shown and described in U.S. Pat. No. 4,669,232 issued on Jun. 2, 1987 to R. L. Wyatt for *Rain Gutter Supports For Dumping Debris* and in U.S. Pat. No. 4,745,657 issued on May 24, 1988 to L. H. Faye for *Hinged Support Bracket Assembly For A Drain Trough.* However, the Wyatt type construction requires the use of spring clips to keep the gutters from pivoting down because they are pivoted at their rear walls; while the Faye-type construction requires the use of a special harness and cooperating bracket construction to mount the trough or gutter. These special clips and harnesses may unduly add to the cost of such constructions and may unduly complicate the use thereof especially under adverse weather conditions. In addition, constructions like those shown and described in these patents require the use of brackets that space the gutters from the building face which may prove undesirable for reasons described above. Such constructions also require that existing gutters mounted on conventional gutter hangers be fully removed in converting from a conventional gutter mounting to ones of the type shown in these patents.

SUMMARY OF THE INVENTION

It is therefore an object of this invention to provide new and improved gutter mountings for buildings.

It is another object of this invention to provide new and improved readily cleanable gutters for buildings and the like.

It is yet another object of this invention to provide new and improved mountings for gutters for buildings and the like to facilitate cleaning of debris from the gutters.

It is still another object of this invention to provide new and improved mountings for gutters for buildings and the like which enable the gutters to be mounted with the inner gutter walls against the building while still permitting the gutters to be rotated to dump debris therefrom.

It is yet still another object of this invention to provide new and improved mountings for gutters for buildings and the like which permit existing hanger mounted gutters to be remounted while in place with new mountings that facilitate gutter cleaning.

It is a further object of this invention to provide new and improved mountings for gutters for buildings and the like which mountings may be secured to hanger mounted gutters while in place, and thereafter and after the hanger mounts are removed, mount the gutters to be rotated from ground level to dump debris therefrom and to be returned to water receiving dispositions.

Other objects, features and advantageous of the invention in its details of construction and arrangement of parts will be seen from the above and from the following description of the preferred embodiments when considered with the drawing and from the appended claims.

BRIEF DESCRIPTION OF THE DRAWING

In the drawing:

FIG. 1 is a side elevational view of a structure or building in the configuration of a dwelling or house upon which is mounted a gutter system incorporating the instant invention;

FIG. 2 is an elevation, enlarged to better show details thereof, of an end of a gutter of the gutter system of the instant invention showing one of the mounting assemblies and cut-away in parts to better show details;

FIG. 3 is a front elevational view of a portion of the gutter system of FIGS. 1 and 2, showing another one of the mounting assembly therefore;

FIG. 4 is a front elevational view of the mounting bracket of the mounting assembly of FIG. 3;

FIG. 5 is a side elevational view of the mounting bracket of FIG. 4;

FIG. 5A is a partial sectional view of the nut end of the pivot pin of FIG. 3;

FIG. 6 is a side elevational view of the gutter system of FIGS. 1-5 showing an end of an operating rod utilized therewith and further showing various positions of the gutter assembly;

FIG. 9 is a front elevational view of one of the mounting assemblies for the gutter system of FIG. 8;

FIG. 12 is a side elevational view of a downspout construction for the gutter system of FIGS. 1-11 incorporating the instant invention;

FIG. 13 is a plan view of corner connection for the gutter systems of FIGS. 1-12 incorporating the instant invention;

FIG. 14 is a side elevational sectional view taken along line 14—14 of FIG. 13;

FIG. 15 is a plan view of the end gasket utilized for the corner connection of FIGS. 13 and 14; and FIG. 16 is an end view of the end gasket of FIG. 15.

DESCRIPTION OF THE PREFERRED EMBODIMENTS

Figure 7:
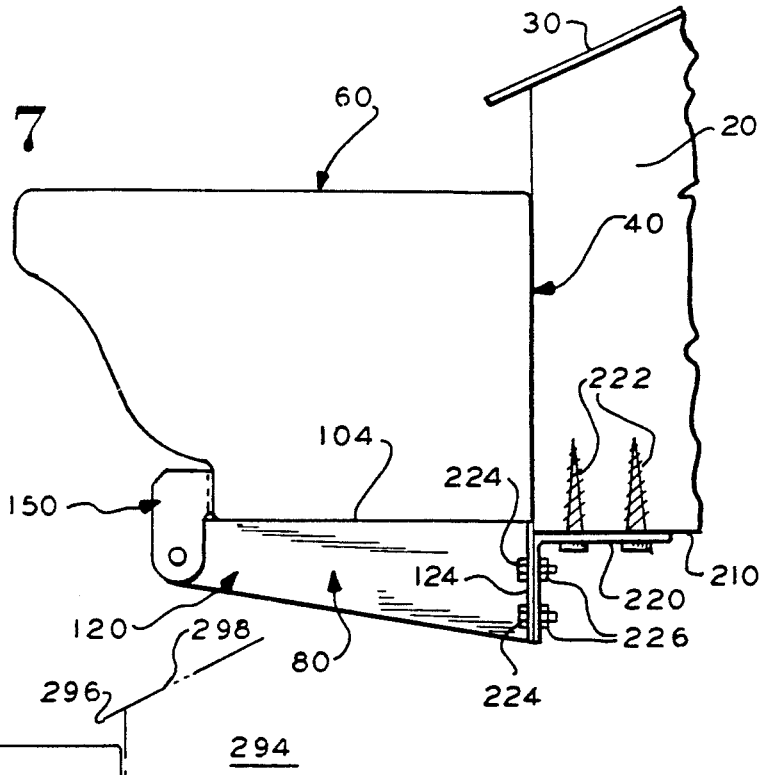
FIG. 7 is a side elevational view of an alternate mounting for the gutter system of FIGS. 1-6.

The invention will be described as applied to a gutter and downspout system for a frame dwelling utilizing gutters and downspouts of aluminum; it being understood that the gutters and downspouts can be fabricated from any conventional material or materials and that the structure or building can be any residential, commercial, factory, farm, industrial or other building which utilizes a gutter system with or without downspouts.

With reference to FIG. 1, there is generally shown at 20 a dwelling in the form of a residence with a side wall 22 and end walls 24, 26, and another side wall (not shown) parallel to side wall 22. A slanted roof 30 is supported in conventional manner on top of walls 22, 24, 26. While dwelling 20 has been shown as a simple box-like construction it should be understood that more complex building constructions can just as well incorporate the gutter and downspout systems of the instant invention.

A facia 40 (FIGS. 1 and 2) is secured to building 20 just below an eve 42 (FIG. 2) of roof 30. Facia 40 is usually fabricated from a board or number of boards of lumber disposed just below eve 42 and extended down a length sufficient to mount a gutter system thereto. Facia 40 may just be disposed on side 22 and on the opposite parallel side of dwelling 20 or additional facia may be disposed on other sides of dwelling 20 especially proximate and beneath other eves or overhangs of roof 30. It should be noted that roof 30 overhangs facia 40 at 50 (FIG. 2) by an amount so that water running down roof 30 spills over an edge 52 and into a gutter 60 (FIGS. 1 and 2) of a gutter assembly 62. A downspout 64 (FIG. 1) extends down proximate one edge of dwelling 20 and a lead pipe 66 extends from gutter assembly 62 to direct water into downspout 64 to be carried away from dwelling 20.

A plurality of gutter mounting assemblies 80 (FIGS. 1 and 2) are connected to facia 40 and gutter 60 to mount gutter 6 to dwelling 20. FIG. 1 shows three mounting assemblies 80 disposed at center lines 82. However, more or less gutter mounting assemblies 80 may be utilized depending upon the length of dwelling 20 and of gutter assembly 82 to be mounted thereon.

FIG. 2, in addition to showing a gutter mounting assembly 80 mounting gutter 60 to facia 40 of dwelling 20 also shows, (in phantom) a conventional gutter hanger 90 as it would appear if gutter 60 was mounted to dwelling 20 by such conventional gutter hangers 90. Each gutter hanger might include a spike-like attaching member 92 with a head 94 at one end and a point 96 at the other end. A tubular sheath 98 surrounds attaching member 92 between a front wall 100 and a rear wall 102 of gutter 60 to support and provide additional spacing for such wall. Gutter 60 also includes a bottom wall 104 and end walls 106, 108 (FIG. 1) which connect and coact with front wall 100 and rear wall 102 to provide a somewhat rigid substantially "U" shaped gutter structure forming a water receiving channel 110 between walls 100, 102 and above wall 104. When a gutter such as gutter 60 is attached to a building like dwelling 20, through gutter hangers 90, sheaths 98 are positioned and attaching members 92 are driven through gutter front wall 100 and rear wall 102 and into building facia 40. A plurality of such conventional gutter hangers would be utilized for each length of gutter and they would be spaced along the length thereof. Instead of driving attaching members 92 through the gutter walls suitable holes may be formed therethrough to receive attaching members 92.

As a practical matter both conventional gutter hangers 90 and gutter mounting assemblies 80 would not be utilized at the same time to secure a gutter to a dwelling since the gutter hangers 90 would prevent operation of mounting assemblies 80. However, FIG. 2 is utilized to describe how conventionally mounted gutters can be converted to readily cleanable gutters incorporating the instant invention without having to first remove the conventionally mounted gutters. It should of course be understood that for new constructions that gutters 60 would be mounted to dwelling 20 directly by the use of gutter mounting assemblies 80 and without the use of conventional gutter hangers 90.

When gutters are mounted to dwelling 20 by conventional gutter hangers 90 it is best to leave the gutters in position and at the appropriate angles to facilitate water flow unless the gutters are to be otherwise replaced. With hangers 90 thus positioning gutters 60 against facia 40 the number of mounting assemblies 80 should be decided upon and their respective center lines 82 (FIG. 1) laid out.

A mounting bracket 120 (FIGS. 2-5) of gutter mounting assemblies 80, is secured, with respect to center line 82, to facia 40 by appropriate securing means such as threaded member 122 (FIGS. 2 and 3). A pair of side plates 124, 126 are formed on each mounting bracket 120 and are each provided with a pair of holes 128 (FIGS. 4 and 5) extending therethrough to permit passage therethrough of threaded members 122 and securing of bracket 120 to facia 40. A support leg 136 extends out from side plate 124 while a similar support leg 138 extends out from side plate 126. A support plate 140 spans and spaces support legs 136, 138 and together therewith forms an inverted substantially "U" shaped support for gutter 60 and upon which floor 104 of gutter 60 rests when supported by gutter mounting assemblies 80 (FIGS. 2 and 3).

A hinge bracket 150 includes a pair of ears 152 (FIGS. 2 and 3) and 154 (FIG. 3) spanned and spaced by a mounting plate 156. Ears 152, 154 extend out and depend down from plate 156 and each include an opening 158 (FIG. 2) extending therethrough. The spacing of ears 152, 154 is such as to permit disposition thereof to the outside right and left of support legs 136, 138 respectively of mounting bracket 120, as shown in FIG. 3, and so that openings 158 are in alignment with openings 160 (FIG. 5) formed through each support leg 136, 138. A pivot pin 170 (FIGS. 2 and 3) extends through aligned openings 158 and 160 and includes a head 172 (FIG. 3) at one end thereof. The other end of pivot pin 170 is threaded at 173 (FIGS. 5 and 5A) to receive a nut 174 (FIGS. 2 and 3) at the other end thereof to secure pivot pin 170 in position connecting mounting bracket 120 and hinge bracket 150 for coaction. Threads 173 extend a relatively short distance in from the end of pivot pin 170 sufficient to receive nut 174 but terminating at 176 (FIG. 5A) so that the distance between thread termination 176 and the underside of head 172 is slightly larger than the spacing of the outside surfaces of ears 152, 154 from each other. As such, when nut 174 is tightened up to thread termination 176 there will be just enough excess length of pivot pin 170 between the underside of head 172 and nut 174 to permit relatively free pivoting of ears 152, 154 about pivot pin 170.

A pair of openings 180 (FIG. 2) are formed through mounting plate 156 each to receive therethrough a securing member such as an externally threaded fastener in the form of a bolt 182. An internally threaded nut 184 (FIG. 2) is secured to each bolt 182 after such are passed through openings 180 and aligned openings 186 formed through lower portion 188 of front wall 100 of gutter 60 to secure gutter 60 to hinge bracket 150 and through pivot pin 170 to mounting bracket 120. When thus secured together bottom wall 104 of gutter 60 rests upon support plate 140 of mounting bracket 120 and rear wall 102 of gutter 60 is disposed against facia 40 of dwelling 20.

Once the selected number of gutter mounting assemblies 80 have been secured to facia 40 and gutter 60 the respective conventional gutter hangers 90 should be removed and gutters 60 will remain in place and be operable, as hereinafter described to be readily displaced to remove debris that may be disposed within gutters 60 and returned to position to receive water from roof 30.

After gutters 60 are disposed on dwelling 20 through gutter mounting assemblies 80 they may be operated from the ground to clean out debris from within gutters 60. A pole or rod 190 (FIG. 6) of suitable length and rigidity carries at its upper end an upper gutter moving pin 192 and a lower gutter moving pin 194. With upper gutter moving pin 192 disposed against an upper lip 196 of front wall 100 of gutter 60 and the application of a suitable force in the direction of arrow A (downwardly) gutter 60 will rotate about pivot pin 170 (FIG. 3) in the direction of arrow X (FIG. 6) from its normal water receiving position on top of support plate 140 through an intermediate position 198 to a dumping position 199. In the dumping position any leaves, twigs, branches or other debris will fall out of gutter 60 or may be removed from gutter 60 with rod 190 or water from a hose or other convenient means or combinations thereof.

After gutter 60 has been cleaned out upper pin 192 is positioned against an upper lip 200 of rear wall 102 of overturned gutter 60 and a suitable force is applied through rod 190 and pin 192 in the direction of arrow B to rotate gutter 60 about pivot pin 170 in the direction of arrow Z. When gutter 60 reaches intermediate position 198 lower pin 194 of rod 190 is positioned against a forward lip 202 of gutter 60 and with the application of suitable force in the direction of arrow C gutter 60 is moved from intermediate position 198 to its normal gutter position seated on top of support plate 140 of mounting bracket 120.

If desired, a spring may be disposed about pivot pin 170 or otherwise mounted to mounting bracket 120 or hinge bracket 150 or a combination of same but so as to urge gutter 60 in the direction of arrow Z (FIG. 6) about pivot pin 170 and so as to urge bottom wall 104 of gutter 60 to sit on top of support plate 140 of mounting bracket 120. The force of such a spring is to be selected so as to permit the ready movement of gutter 60 to its overturned position as shown in FIG. 6.

Sometimes gutter 60 is mounted to facia 40 so that the incline of gutter 60 places its bottom wall 104 at almost the same level or close to a lower edge 210 (FIG. 7) of facia 40. As such the disposition of openings 128 (FIGS. 4 and 5) of either side plate 124 or of both side plates 124, 126 of mounting bracket 120 may be too low to extend fasteners therethrough and into facia 40 to secure mounting bracket 120 to facia 40. In such situations an "L" shaped bracket 220 (FIG. 7) is secured in place to lower edge 210 of facia 40 by two or more fasteners such as threaded members 222. "L" bracket 220 may be only long enough to accommodate side plate 124 (FIGS. 4 and 5) or it may be long enough to accommodate both side plate 124 and 126. Once "L" bracket 220 is secured to facia 40 openings provided therethrough are aligned with openings 128 in side plates 124 and 126 (if need be) and mounting bracket 120 is secured to "L" bracket 220 by suitable fastening means such as threaded fasteners 224 and threaded nuts 226.

Gutter 60 is connected to hinge bracket 150 and through a hinge pin 170 to mounting bracket 120 as described for the connection of gutter 60, hinge bracket 150 and pivot pin 170 for the FIGS. 1–6 embodiment. Once gutter 60 is so connected to mounting bracket 120 gutter 60 may be rotated from its water catching position of FIG. 7 to a debris dumping position as shown in FIG. 6 for gutter 60 therein.

Figure 8:
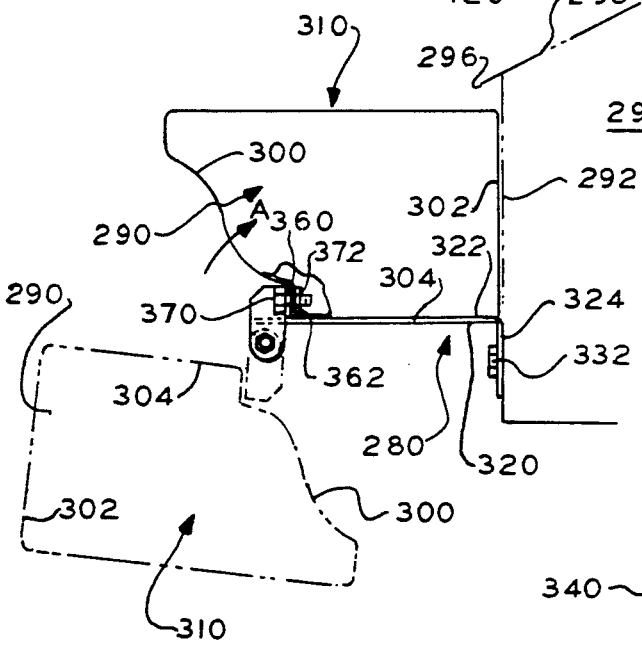
FIG. 8 is a side elevational view of yet another alternate mounting for the gutter system incorporating the instant invention.

In FIG. 8 an alternative gutter mounting assembly 280 is shown for mounting a gutter 290 to and up against a facia 292 of a building 294 and so as to be positioned to catch water flowing over an edge 296 of a roof 298 of building 294. Gutter 290 included a front wall 300, a rear wall 302 and a bottom wall 304 all connected or formed integrally to provide an elongated and continuous gutter assembly 310.

Figure 10:
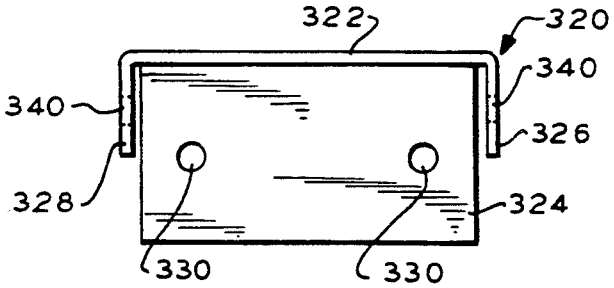
FIG. 10 is a front elevational view of the mounting bracket for the mounting assembly of FIG. 9.
Figure 11:
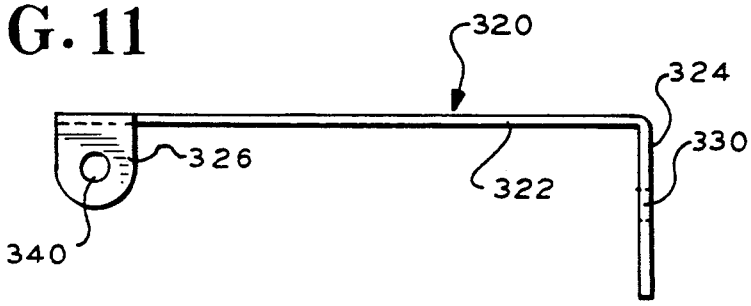
FIG. 11 is a side elevational view of the mounting bracket of FIG. 10.

Gutter mounting assembly 280 includes a mounting bracket 320 (FIGS. 8–11) having a gutter support plate 322 with a mounting plate 324 extending downwardly therefrom, at a right angle, at one end thereof and a pair of ears 326, 328 (FIGS. 9 and 10) depending downwardly proximate the other end at the sides thereof. A pair of openings 330 (FIGS. 10 and 11) are formed through mounting plate 324 to receive attaching means such as threaded fasteners 332 (FIGS. 8 and 9) which are utilized to secure mounting plate 324 and thereby mounting bracket 320 to facia 292 as shown in FIG. 8.

A pair of aligned openings 340 (FIG. 11) are formed through ears 326 and 328 respectively and for alignment with openings 342, 344 (FIG. 9) respectively of a pair of hinge brackets 350, 352. Each hinge bracket 350, 352 includes a pair of openings 360 (FIG. 8) which extend therethrough and are to be disposed in alignment with openings 362 formed through front wall 300 of gutter 310 proximate bottom wall 304 thereof. An externally threaded fastener 370 is extended through each of the aligned openings 360 and 362 and receives an internally threaded nut 372 to attach and secure each hinge bracket 350, 352 in spaced relationship to gutter 310. The spacing of hinge brackets 350, 352 on gutter 310 is selected so that ears 380, 382 respectively thereof are disposed outside (to the right and left respectively) but in proximity to ears 326, 328 respectively of mounting bracket 320 as shown in FIG. 9.

Openings 342, 344, which extend through ears 380, 382, are aligned with openings 340 of ears 326, 328 of mounting bracket 320 when mounting bracket 320 is secured to facia 292 and when hinge brackets 350, 352 are secured to gutter 310 for cooperation therewith. The shank 388 (FIG. 9) of a pivot pin 390 extends through aligned openings 342, 340, 340 and 344 until a head 392 disposed at one end of shank 388 is disposed proximate ear 380 of hinge bracket 350. The other end of shank 388 is externally threaded at 394 to receive an internally threaded nut 396 to secure pivot pin 390 in place.

A washer 398 may be placed about pivot pin 390 between ear 380 of hinge bracket 350 and ear 326 of mounting bracket 320 while another washer 398 may be placed about pivot pin 390 between ear 382 of hinge bracket 352 and ear 328 of mounting bracket 320 to properly space the elements and facilitate rotation of hinge brackets 350, 352 about the axis of rotation of pivot pin 390. Pivot pin 390 may also be disposed with its head 392 disposed proximate ear 382 and with nut 396 disposed proximate ear 380.

If desired, a spring may be disposed about pivot pin 390, or otherwise carried by mounting bracket 320 and/or hinge brackets 350, 352 or a combination thereof, so as to urge gutter 310 in the clockwise direction about pivot pin 390 [in the direction of arrow A (FIG. 8)] to facilitate seating of bottom wall 304 of gutter 310 on top of support plate 322 of mounting bracket 320. The bias of such a spring is selected so as not to interfere with rotation of gutter 310 from its water receiving disposition as shown in solid lines in FIG. 8 to its debris dumping disposition as shown in phantom lines in FIG. 8.

A plurality of gutter mounting assemblies 280 are disposed in spaced relationship along the length of gutter 310; each such assembly 280 connected to gutter 310 and facia 292 of building 294 as described above with reference to FIGS. 8–11. Gutter mounting assemblies 280 may be utilized to secure a gutter otherwise hung on a building by conventional gutter hangers while such gutter hangers are in place, to thus convert a conventional gutter system to the readily cleanable gutter system of this invention. Once gutter mounting assemblies 280 are connected to the gutters and the building facia the conventional gutter hangers may be removed.

Movement of gutter 310 between its water receiving disposition and its debris dumping disposition may be accomplished while the operator is standing on the ground and through the use of a rod with pins such as rod 190 and pins 192, 194 as described above with reference to FIG. 6.

In FIG. 12 there is shown a gutter system 400 mounted to a facia 402 of a building 404 to receive water from a roof 406 of building 404. A plurality of gutter mounting assemblies 410 mount gutter system 400 to building 404 as described above for gutter 60 and its gutter mounting assemblies 80 (FIGS. 1-6). Alternatively, gutter mounting assemblies 280 may be utilized to secure gutter system 400 to building 404 as described above for FIGS. 8-11.

One or more lead pipes 420 extend down through suitable openings formed through selected gutters 422 of gutter system 400 to direct water from gutters 422 to downspouts 430 selectively positioned around building 404. Downspouts 430 include one or more members 432, 434 conventionally secured by suitable means to each other and by straps 436 or the like to building 404. A funnel-like spout 440 is fitted into an upper end 442 of each downspout 430 and surrounds a lower end 444 of lead pipe 420 to receive water therefrom.

The configuration of spout 440 at its upper end and of lead pipe 420 at its lower end 444, the respective sizes thereof and the extent to which lower end 444 of lead pipe 420 extends into spout 440 are selected to permit rotation of lower end 444 of lead pipe 420 out from spout 440 when gutter 42 is rotated from its water receiving disposition (as shown in FIG. 12) to a debris dumping position similar to that shown for gutter 60 in FIG. 6 and gutter 310 of FIG. 8.

If desired, a plurality of reinforcing spacers 450 may be disposed at selected spaced intervals along the length of gutter 422 (or gutters 60 of FIGS. 1-6 or gutter 310 of FIGS. 8-11). Each reinforcing spacer 450 includes a tube-like reinforcing sheath 452 through which a threaded member 454 extends from a head end 456 that anchors against rear wall 458 of gutter 422 to a shank end 460 that receives an internally threaded nut 462 that rests against an outside surface of front wall 464 of gutter 422. Suitably aligned openings are formed in front wall 464 and rear wall 458 of gutter 422. Where gutter mounting assemblies as described above are utilized to convert conventional gutter hangers hung gutters to gutter systems of the instant invention existing aligned holes formed through gutter front and rear walls for the conventional gutter hangers may be utilized to receive reinforcing spacers 450, as described above, once the conventional gutter hangers are removed.

Some gutter systems meet at building corners as shown for a gutter system 500 in FIGS. 13-15. Gutter system 500 includes a first gutter assembly 510 (FIG. 13) and a second gutter assembly 512 which meet at respective ends 514, 516 of a gutter corner piece 520. Gutter piece 520 is of conventional construction and is secured to a facia 522 by conventional gutter hangers 524 as described above with respect to gutter hangers 90 of FIG. 2. Each end 514, 516 of gutter piece 520 receives a seal 530 molded or otherwise formed from rubber, plastic or the like. Each seal 530 includes a body 532 (FIGS. 15 and 16) formed with a groove 534. Grooves 534 and body 532 are of a size and configuration and otherwise formed so that ends 514, 516 of gutter piece 520 are received in grooves 534 and so that a seal 530 extends about the periphery of each end 514, 516 from a top 540 (FIGS. 13 and 14) of a front wall 542 of gutter piece 520 to a top 550 of a rear wall 552 of gutter piece 520.

Gutters 560 of gutter assembly 510 and gutters 562 of gutter assembly 512 are of identical cross-sectional configuration as that of gutter piece 520. Each such gutter assembly 510, 512 is mounted to facia 522 by gutter mounting assemblies of the type described hereinabove with respect to the descriptions of the embodiments of FIGS. 1-6 or FIGS. 8-11 so that gutter assemblies may be selectively moved between water receiving dispositions and debris dumping dispositions.

A seal member 530 is disposed on an end 570 of gutter 560 in the same manner that seal 530 is disposed at end 514 of gutter piece 520. Similarly, a seal 530 is disposed at an end 572 of gutter 562 in the same manner that seal 530 is disposed at end 516 of gutter piece 520. Ends 514 of gutter piece 520 and 570 of gutter 560 are initially spaced one from the other so that when seals 530 are disposed thereon and gutter assembly 510 is aligned with gutter piece 520 outside edges 580 (FIGS. 15 and 16) of seals 530 will be disposed in water sealing dispositions one proximate the other. In similar manner ends 516 of gutter piece 520 and 572 of gutter 562 are initially spaced one from the other so that when seals 530 are disposed thereon and gutter assembly 512 is aligned with gutter piece 520 outside edges 580 of seals 530 are disposed in water sealing disposition. The respective disposition of seals 530 are such as to permit the selected movements of gutter assemblies 510, 512 between their water receiving dispositions and their debris dumping dispositions.

From the above description it will thus be seen that there has been provided new and novel gutter systems and gutter mounting assemblies which provide gutters that can be selectively moved, by a person disposed on the ground, between water receiving dispositions and debris dumping dispositions; such gutter systems being, furthermore, establishable by converting conventional hanger hung gutters to selectively movable gutters while the conventionally hung gutters are in place.

It is understood that although there has been shown and described preferred forms of the invention that various modifications may be made in the details thereof without departing from the spirit as comprehended by the following claims.

What is claimed is:

1. A gutter system; comprising:

(a) gutter assembly means including a front gutter wall spaced from a rear gutter wall with a bottom gutter wall connecting said front gutter wall and said rear gutter wall in spaced relationship and into a predetermined cross-sectional configuration with a gutter water receiving channel formed between said spaced front and rear walls and above said bottom wall; and (b) gutter mounting means connected to said gutter assembly means and connectable to a building proximate the roof thereof to position said water receiving channel to receive water from the building roof;

(c) said gutter mounting means including pivot means permitting rotation of a first portion of said gutter mounting means with respect to a second portion of said gutter mounting means, said first portion of said gutter mounting means being connected to said gutter assembly means and said second portion of said gutter mounting means being connectable to the building to mount said gutter assembly means so that an outer surface of the rear gutter wall may be disposed against a predetermined wall of the building, and for selective movement between a water receiving position and an overturned disposition enabling debris which might be in said water receiving channel to be dumped therefrom.

2. The gutter system of claim 1, wherein said predetermined cross-sectional configuration is one that is substantially "U" shaped.

3. The gutter system of claim 1, wherein said first portion of said gutter mounting means is connected to said gutter assembly means proximate an intersection of said front gutter wall and said bottom gutter wall.

4. The gutter system of claim 3, wherein said first portion of said gutter mounting means is connected to said front gutter wall of said gutter assembly means proximate where said front gutter wall meets said bottom gutter wall.

5. The gutter system of claim 1, wherein said first portion of said gutter mounting means includes at least one hinge bracket and said second portion of said gutter mounting means includes at least one gutter mounting bracket and said pivot means connects said hinge bracket to said gutter mounting bracket.

6. The gutter system of claim 5, wherein said first portion of said gutter means includes a pair of hinge brackets disposed in spaced relationship one with respect to the other when connected to said gutter assembly means.

7. The gutter system of claim 5, wherein said pivot means includes a pivot pin having a head at one end and which receives a nut at its other end and which is inserted through aligned opening formed respectively through said first portion of said gutter mounting means and said second portion of said gutter mounting means.

8. The gutter system of claim 5, wherein said gutter mounting bracket includes a gutter support means upon which said gutter assembly rests when in its water receiving disposition.

9. The gutter system of claim 8, including spring means carried by said gutter mounting means and urging said gutter assembly means into said water receiving disposition.

10. The gutter system of claim 1, including an additional mounting bracket connected to said second portion of said gutter mounting means and, in turn, connectable to a facia of a building beneath a lower edge thereof.

11. The gutter system of claim 1, including an elongated pole or rod having at least a first gutter operating means extending therefrom and operable from a position in the hands of a person positioned proximate the ground to coact with said gutter assembly means when mounted to a building to selectively move said gutter assembly means between said water receiving position and said overturned disposition thereof.

12. The gutter system of claim 1, including downspout means disposable for coaction with said gutter assembly means to receive water therefrom and lead pipe means connected to said bottom wall of said gutter assembly means to direct water therefrom into said downspout means, said downspout means including a flared out upper extremity which receives said lead pipe means and coacts therewith to permit movement thereof and of said gutter assembly means between said water receiving disposition and said overturned disposition.

13. The gutter system of claim 1, wherein said gutter assembly means is open at at least one end thereof and first seal means disposed along said end of said gutter assembly means, at least one gutter piece to be fixedly secured to a building proximate a corner thereof and a second seal means disposed along an edge of said gutter piece said first seal means and said second seal means being disposed in close proximity to each other when said gutter assembly means and said gutter piece are disposed one proximate the other but so as to permit selective movement of said gutter assembly means between said water receiving disposition and said overturned disposition.

14. The gutter system of claim 1, including a plurality of reinforcing spacers spanning said front gutter wall and said rear gutter wall.

15. The method of converting a gutter system fixedly mounted to a building by conventional gutter hangers to a gutter system permitting selective movement of the gutters of said gutter system between water receiving dispositions and overturned dispositions facilitating dumping of debris that might be in the gutters; comprising:

(a) providing a plurality of gutter mounting means;
(b) securing said gutter mounting means in spaced relationship to the gutters of the gutter system and to the building while the conventional gutter hangers secure the gutters to the building; and
(c) removing the conventional gutter hangers from the gutters and the building after connecting the gutters to the building by said gutter mounting means.

16. The gutter conversion method of claim 15; including:

(a) providing each gutter mounting means with a first gutter mounting portion and a second gutter mounting portion;
(b) pivotally connecting said first gutter mounting portion to said second gutter mounting portion;
(c) securing said first gutter mounting portions to the gutters;
(d) securing said second gutter mounting portions to the building; and
(e) applying a predetermined force to an upper edge of the gutter by a rod operated from proximate a ground position to selectively pivot the gutter, about said pivot means, from a water receiving disposition to an overturned disposition; and
(f) applying a predetermined force to a lower edge of the gutter by a rod operated from proximate a ground position to selectively pivot the gutter, about said pivot means, from said overturned disposition to said water receiving disposition.

17. The gutter conversion method of claim 16, including securing the gutters to the building by said gutter mounting means so that a rear wall of the gutters are disposed against the building.

18. The gutter conversion method of claim 16, including securing said first gutter mounting portions to the gutters proximate an intersection of front gutter walls and bottom gutter walls of the gutters.

19. The gutter conversion method of claim 18, including securing said first gutter mounting portions to the gutters at front walls thereof proximate where the front walls meet the bottom walls.

20. The gutter conversion method of claim 15, including providing at least one hinge bracket for said first portion of said gutter mounting means, providing at least one gutter mounting bracket for said second portion of said gutter mounting means and providing said pivot means so as to connect said hinge bracket to said gutter mounting bracket.

21. The gutter conversion method of claim 20, wherein said first portion of said gutter means includes a pair of hinge brackets disposed in spaced relationship one with respect to the other when connected to said gutter assembly means.

22. The gutter conversion method of claim 20, wherein said pivot means includes a pivot pin having a head at one end and which receives a nut at its other end and which is inserted through aligned openings formed respectively through said first portion of said gutter mounting means and said second portion of said gutter mounting means.

23. The gutter conversion method of claim 20, including providing said gutter mounting bracket with a gutter support means upon which said gutter assembly rests when in its water receiving disposition.

24. The gutter conversion method of claim 23, including providing spring means to be carried by said gutter mounting means for urging said gutter assembly means into said water receiving disposition.

25. The gutter conversion method of claim 15, including providing an additional mounting bracket, connecting said additional mounting bracket to said second portion of said gutter mounting means and, in turn, to a facia of a building beneath a lower edge thereof.

26. The gutter conversion method of claim 15, including providing an elongated pole or rod having at least a first gutter operating means extending therefrom and operable from a position in the hands of a person positioned proximate the ground to coact with said gutter assembly means when mounted to a building to selectively move said gutter assembly means between said water receiving position and said overturned disposition thereof.

27. The gutter conversion method of claim 15, including providing downspout means disposable for coaction with said gutter assembly means to receive water therefrom and lead pipe means connected to said bottom wall of said gutter assembly means to direct water therefrom into said downspout means, providing said downspout means with a flared out upper extremity to which receive said lead pipe means and to coact therewith to permit movement thereof and of said gutter assembly means between said water receiving disposition and said overturned disposition.

28. The gutter conversion method of claim 15, including providing said gutter assembly means with an opening at at least one end thereof and first seal means disposed along said end of said gutter assembly means and at least one gutter piece to be fixedly secured to a building proximate a corner thereof and a second seal means disposed along an edge of said gutter piece said first seal means and said second seal means disposed in close proximity to each other when said gutter assembly means and said gutter piece are disposed one proximate the other but so as to permit selective movement of said gutter assembly means between said water receiving disposition and said overturned disposition.

29. The gutter conversion method of claim 1, including providing a plurality of reinforcing spacers spanning said front gutter wall and said rear gutter wall.

* * * * *